United States Patent [19]

Hylton

[11] Patent Number: 4,635,802

[45] Date of Patent: Jan. 13, 1987

[54] BRIDGE CRANE CONTROL UNIT

[76] Inventor: Douglas W. Hylton, 14312 SE. River Rd., Milwaukie, Oreg. 97267

[21] Appl. No.: 813,689

[22] Filed: Dec. 27, 1985

[51] Int. Cl.[4] ..... B66C 13/40

[52] U.S. Cl. ..... 212/160; 414/1; 414/7; 901/12; 74/471 R; 74/471 XY

[58] Field of Search ..... 212/160; 244/237; 901/12; 414/1, 7; 74/471 R, 471 XY, 497, 501 R

[56] References Cited

U.S. PATENT DOCUMENTS

| | | | |
|---|---|---|---|
| 3,018,750 | 1/1962 | Hill | 74/471 XY |
| 3,073,347 | 1/1963 | Bent et al. | 74/471 R |
| 3,589,242 | 6/1971 | Peterson | 74/471 R |
| 3,707,093 | 12/1972 | Worden | 74/471 XY |

FOREIGN PATENT DOCUMENTS

| | | | |
|---|---|---|---|
| 2222063 | 11/1973 | Fed. Rep. of Germany | 212/160 |

*Primary Examiner*—Galen L. Barefoot
*Assistant Examiner*—Thomas J. Brahan
*Attorney, Agent, or Firm*—Chernoff, Vilhauer, McClung & Stenzel

[57] ABSTRACT

A one-hand-operable control unit for a bridge crane. A cam, rotated by pointing a control handle in the direction toward which it is desired for the bridge crane hoist to be moved, operates switches which connect power to the appropriate motors of the bridge crane to move the hoist longitudinally, laterally, or diagonally when a thumb-operated traverse power control switch, located on the control unit handle, is closed. Switches are conveniently located on the front of the control handle to control load-raising and lowering operation of the hoist motor. A flexible hollow shaft connecting the control handle with the cam rotates the direction-controlling cam in response to pointing the handle toward the direction of traverse movement desired.

11 Claims, 9 Drawing Figures

BRIDGE CRANE CONTROL UNIT

BACKGROUND OF THE INVENTION

The present invention relates to bridge cranes, and particularly to a control unit requiring only one hand of an operator to be used to control the direction and speed of traversing movement of the hoist portion of such a bridge crane.

A bridge crane includes a pair of elevated parallel rails extending longitudinally along opposite sides of an area within which the bridge crane is designed to lift, carry, and lower loads. A bridge extends horizontally between the longitudinal rails and is movable along the rails, usually by electrically powered motors. A hoist is located on a hoist carriage which may be moved along the bridge, between the longitudinal rails of the bridge crane. A motor is usually provided for moving the hoist carriage along the bridge, and the hoist also includes a motor for raising and lowering suspended loads.

Previously known bridge crane control units are typically suspended on flexible pendant cables whose upper ends are attached to the hoist carriage. Usually several push-button switches are provided on such pendant control units, with each push-button controlling operation of a part of the bridge crane in a single direction. Thus, there are usually at least six push-buttons located on such a pendant control unit. While such push-button switches are normally labeled, the labels may be missing or worn away. The labels provided may be somewhat confusing, as well, since terms such as "forward" or "reverse" often do not give a clear indication of which direction the hoist carriage or bridge is going to move when that particular switch is closed. As a result, operators must become familiar with each particular bridge crane installation, and mistakes are likely to occur.

It is frequently desirable to save time by moving a load suspended from a bridge crane in a diagonal traversing direction. This can be accomplished using the previously known pendant control unit only by simultaneously pushing two buttons, to move the bridge along the rails and to move the hoist carriage along the bridge simultaneously. Since operating two push-buttons simultaneously normally requires the use of both hands, an operator is unable to move a load diagonally and also hold the load with one hand to steady it while it is being moved by the bridge crane.

While some attempts have been made to improve upon the conventional pendant control units for bridge crane, these have not been entirely satisfactory. For example, Somborn et al., U.S. Pat. No. 4,209,681 discloses a control unit which improves upon the conventional pendant control unit by providing switches arranged to be easily visible and to be comfortable for the operator's hand, but there are still an inconveniently large number of switches contained in the Somborn et al., unit.

Raetz U.S. Pat. No. 3,931,486 includes an easily gripped control handle for a hoist. A single rocker switch is located conveniently for operation by the operator's thumb, but this control unit does not provide any control over the direction of traversing movement of a bridge crane. Instead the thumb-operated lever controls merely the speed of operation of a hoist motor.

Cordes U.S. Pat. No. 3,755,725 provides a pistol grip connected by a rod to the hook of a hoist to control manually the lateral movement of a load being lifted or lowered. A rocker switch is provided in the pistol grip to control raising and lowering operation of the hoist. Alternatively, push buttons may be provided on the rear side of the pistol grip for controlling operation of the hoist motor. The Cordes device does not provide for control of motors to move the hoist mechanism laterally or longitudinally.

None of the above-identified devices, however, deals with control of the direction of traversing movement of a bridge crane hoist in a way which makes it possible to control such a bridge crane using only one of an operator's hands.

What is needed, therefore, is a control unit which provides for safe control of the direction of traversing movement of a hoist assembly, as well as control over the raising and lowering operation of the hoist, which provides for diagonal, as well as straight lateral traversing movement of the hoist carriage along the bridge or longitudinal movement of the bridge along the rails of a bridge crane, and which requires the use of only one hand by the crane operator.

SUMMARY OF THE INVENTION

The present invention provides a bridge crane control unit which overcomes the above-mentioned shortcomings and disadvantages of the previously known devices used for controlling bridge cranes. According to the present invention, a control handle having a convenient pistol-grip shape includes a switch operable by a push-button located where it can easily be pressed by the operator's thumb, regardless of which hand is used to grasp the pistol grip. This push-button thumb-switch causes operation of traverse drive motors so long as it is pressed. The control handle is connected, preferably through a flexible hollow shaft, to a cam which opens and closes respective traverse motor control switches to provide electrical power to the appropriate traverse motors to move the hoist of the bridge crane in the appropriate longitudinal, transverse, or diagonal direction, according to the direction in which the control handle pistol grip is pointed. Sliprings permit unlimited rotation of the control handle.

Thus, the traversing movement of a load in a desired longitudinal, transverse, or diagonal direction may be effected by rotating the pistol grip, thereby rotating the cam connected with the pistol grip by the flexible shaft, and closing the thumb-operated push-button switch until the load has been moved the desired distance.

Preferably, a pair of switches are provided on the front face of the pistol grip, where either may be squeezed by one finger of the operator's hand to energize a hoist motor to raise or lower a load suspended from the hoist.

Preferably, the switches located on the control handle are provided with low voltage power and are connected to relays which complete the necessary circuits to provide line power to the appropriate motors to move the bridge crane as desired.

The cam rotated by movement of the control handle is designed to provide hoist movement in a longitudinal or lateral traversing direction, so long as the control handle connected with the cam is pointed within a sector of, for example, 45° in width centered on the corresponding lateral or longitudinal direction. Within such a sector, only the traverse motor connected to move the bridge along the rails, or the traverse motor connected for moving the hoist carriage along the bridge, will be activated. When the control handle is pointed into one of the 45° sectors remaining between the longitudinally-centered and laterally-centered sectors, traversing movement will be effected both along the rails and along the bridge, providing diagonal movement of the hoist.

It is therefore a principal object of the present invention to provide a bridge crane control unit by which an operator need use only one hand to control the direction of traversing movement of a bridge crane hoist and also to control lowering and raising of a load suspended from the hoist.

It is another important object of the present invention to provide a control unit which automatically causes the bridge crane hoist assembly to traverse in the general direction in which the operator points the control unit, so that the operator can simply walk in the direction in which the control unit is pointing, while accompanying a load being carried by the bridge crane.

It is a further object of the present invention to provide a control unit which eliminates accidental traversing movement of a load in an undesired direction.

It is an important feature of the present invention that it provides a control unit including a single manually-operated switch connected electrically for automatically operating the appropriate motors for traversing movement of a bridge crane hoist in a desired direction.

It is another feature of the present invention that it provides a bridge crane control unit incorporating a set of switches operated by a cam to control direction of traversing movement of the hoist assembly according to the direction toward which a control unit is pointed.

It is a further feature of the present invention that it incorporates low voltage relays to isolate the control unit from the higher voltage power used to operate bridge crane motors.

It is a principal advantage of the present invention that it improves the safety of operation of a bridge crane.

It is another important advantage of the present invention that it greatly reduces the likelihood of confusion between switch buttons incorporated in the control unit, thus reducing the chance of moving a load in an undesired direction.

It is another advantage of the present invention that it requires only one hand for its operation, leaving the operator's other hand free to guide a load.

It is yet a further advantage of the present invention that it allows a bridge crane operator to observe a load being raised and transported at all times during the operation.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
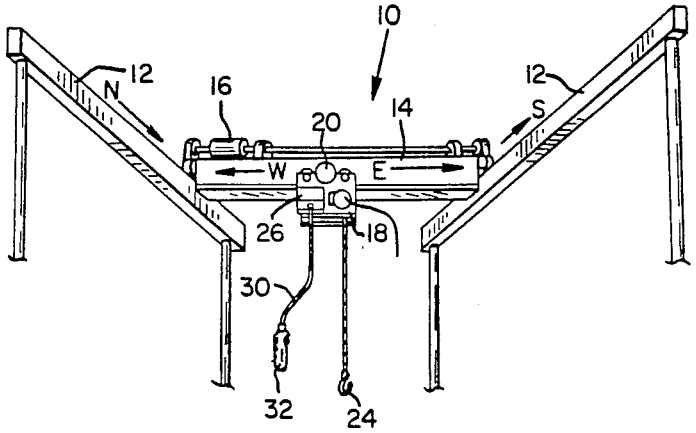
FIG. 1 is a perspective view of a bridge crane including a control unit embodying the present invention.

Referring now to the drawings, a bridge crane 10 shown in FIG. 1 includes a pair of parallel longitudinal rails 12 supported at an elevated height in a work area, such as a large warehouse in which heavy goods are stored in various locations.

A bridge 14 extends laterally between the longitudinal rails 12, and is movable along the longitudinal rails 12 under the power of a bridge traverse motor 16, as is well known in bridge cranes.

A hoist carriage unit 18 is supported by the bridge 14 and includes a hoist carriage traverse motor 20 arranged, as is well known, to move the hoist carriage 18 laterally of the bridge crane 10 along the bridge 14. A hoist motor 22 is also provided and is connected to drive a hoisting mechanism to selectively raise or lower a suspended hook 24 or other attachment for supporting a load. A one-hand bridge crane control unit 26 embodying the invention is mounted on the hoist carriage 18 for movement along with the hoist carriage 18 as it traverses laterally along the bridge 14, and as the bridge 14 traverses along the longitudinal rails 12. Suitable power cables and connections for powering the bridge traverse motor 16, hoist carriage traverse motor 20, and hoist motor 22 are well known, and are therefore not depicted in FIG. 1.

Figure 2:
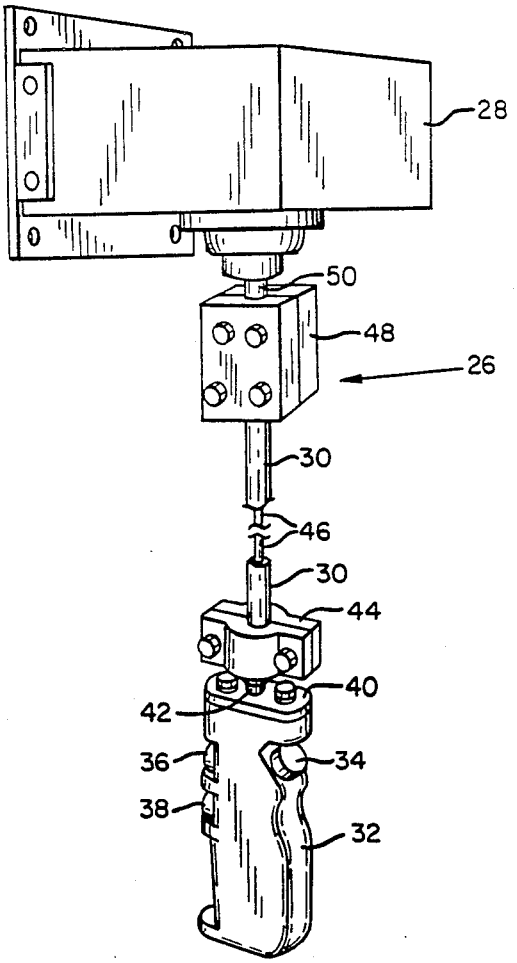
FIG. 2 is a view of the control unit shown in FIG. 1, at an enlarged scale.

Referring next to FIG. 2, the crane control unit 26 is seen to include a protective housing 28, normally fixedly attached to the hoist carriage 18 for travel therewith. Extending generally vertically downward beneath the housing 28 is a cam drive flexible shaft 30. Supported by the flexible shaft 30, at its lower end, is a control handle 32. Preferably, the control handle 32 has the general form of a pistol grip.

Figure 3:
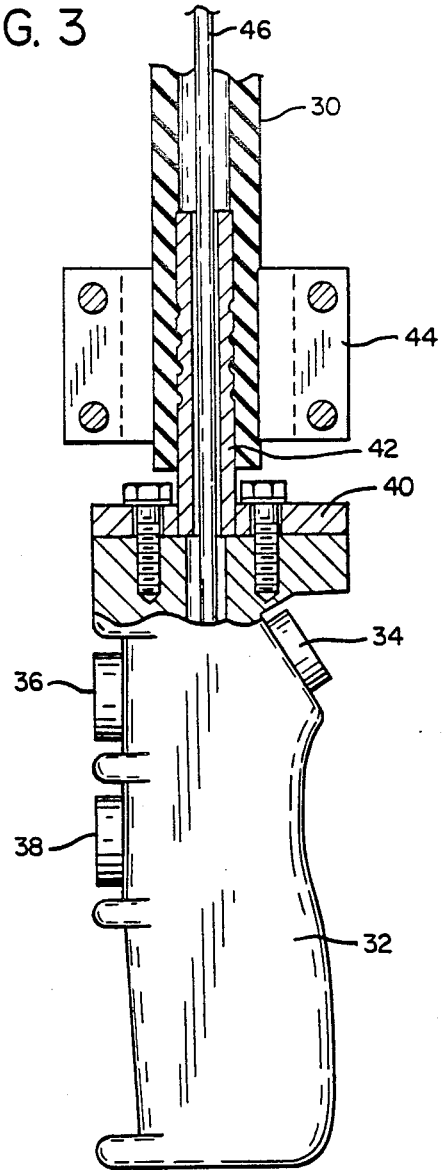
FIG. 3 is a view of the control handle portion of the control unit shown in FIG. 2, at an enlarged scale.

As seen in FIGS. 2 and 3, the control handle 32 includes a traverse power control switch 34 of the push-button momentary contact type, for example, a single pole, normally open, 6-amp 120-V AC switch manufactured by Cutler-Hammer of, Milwaukee, Wis., and sold as the Eton Compu-lite switch #881K11810. The switch 34 is located on the rear side of the control handle 32, near the top of the pistol grip, where it can be pushed by the operator's thumb, while the operator uses either hand to grasp the control handle 32. The traverse power control switch 34 is connected, as will be explained hereinafter in more detail, to energize the carriage and hoist traverse motors 16 and 20 while the button is depressed.

On the front face of the pistol grip control handle 32 is a hoist raise control switch 36, also a momentary contact switch similar to the switch 34, which is located in a position to be easily pressed by an operator's index finger, using either hand to grip the control handle 3. Located below the hoist raise switch 36 is a hoist lower switch 38, also a momentary contact switch similar to the switch 34. The hoist lower switch 38 is located in a position where it is easily accessible to be pressed by the operator's middle finger. The hoist raise switch 36, when pressed, causes the hoist motor 22 to raise the hook 24, and similarly, the hoist lower switch 38, when pressed, causes the hoist motor 22 to lower the hook 24. The relative positions of these hoist motor control switches 36 and 38 bear a close logical connection with the function which they provide, making it unnecessary to provide labels for these switches.

As may be seen in the sectional view portion of FIG. 3, the control handle 32 includes an upper connector portion 40 including a tubular upwardly projecting neck 42, and a clamp 44 is provided to securely fasten the flexible shaft 30 to the neck 42. Preferably, the flexible shaft 30 is of a sturdy hose material such as a wire-reinforced hydraulic hose material. A suitable electrical cable 46 extends through the interior of the flexible shaft 30 to provide electrical connection between the control switches 34, 36 and 38 and the electrical portions of the control unit which are contained within the housing 28 and which will be described presently.

Figure 4:
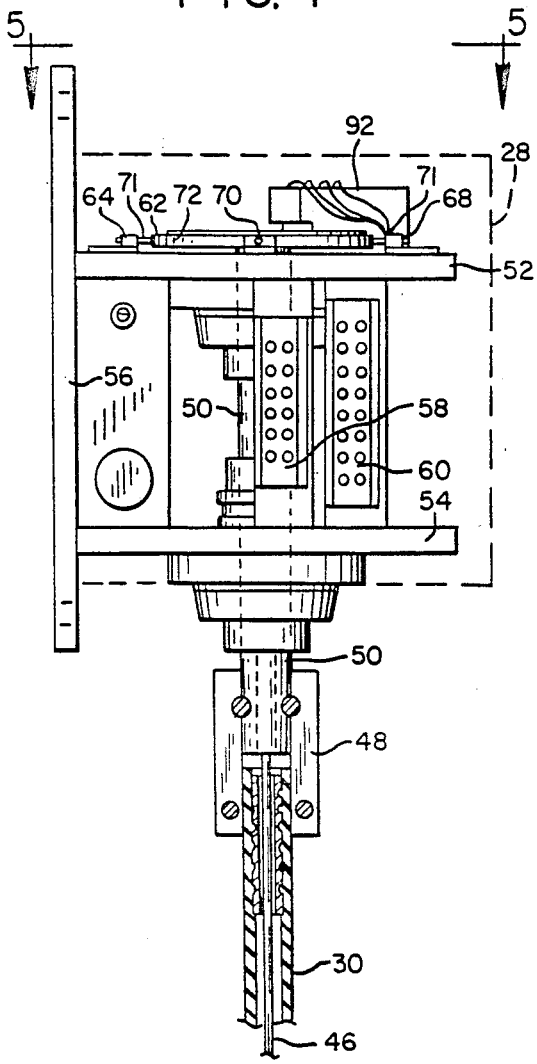
FIG. 4 is a side view of an upper portion of the control unit shown in FIG. 2.

A clamp 48 (FIGS. 2 and 4) is provided to fasten the upper end of the flexible shaft 30 to a cam shaft 50 which is carried by suitable radial and thrust bearings to support the weight of the control handle 32, control flexible cable 30, and the clamps 44 and 48. The cam shaft 50 is thus free to rotate in response to rotation of the control handle 32.

An upper bearing support plate 52 and a lower bearing support plate 54 are fixedly attached to a mounting plate 56 used to fasten the crane control unit 26 to the hoist carriage 18. Terminal boards 58 and 60 are mounted between the upper and lower bearing support plates 52 and 54 to provide for electrical connections within the control unit 26 and between the control unit 26 and the necessary power supply cables (not shown). Located above the upper bearing support plate 52 is a radial disk cam 62, fixedly attached to the cam shaft 50 for rotation therewith. The cam 62 may be made of a machinable, hard, electrically non-conductive cotton-reinforced laminate material such as that manufactured by the Westinghouse Corp. of Hempton, S.C., under the trademark "MICARTA."

Figure 5:
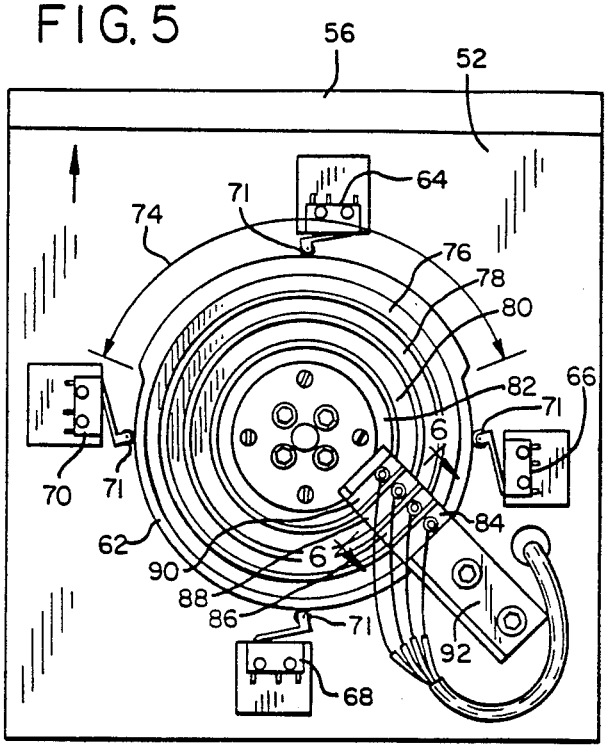
FIG. 5 is a top view of a cam and switch unit included in the portion of the control unit shown in FIG. 4, showing a slipring and brush assembly associated with the cam.
Figure 6:
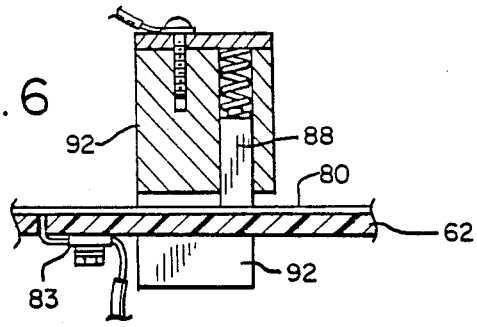
FIG. 6 is a detail of a brush and slipring shown in FIG. 5, taken along line 6—6.

Four traverse motor control switches 64, 66, 68 and 70 are mounted on the upper bearing support plate 52. Reference herein is made to the traverse motor control switches by arbitrary direction labels. Thus, the traverse motor control switch 64 may be called a north traverse motor control switch; 66, east; 68, south; and 70, west, corresponding to their positions as shown in FIG. 5. The traverse motor control switches 64, 66, 68 and 70 are preferably microswitches, for example 5-amp, 250-volt AC microswitches, operated by respective levers equipped with rollers 71. The switches are located relative to the radial disk cam 62 so that the rollers 71 act as cam followers and follow the circumferential face 72 of the cam 62. The circumferential face 72 is of such a shape that as the radial disk cam 62 is rotated, a switch-closing cam sector 74 electrically closes any of the traverse control switches 64, 66, 68 and 70 whose roller 71 is within the sector 74. Thus, with the traverse control switches 64, 66, 68, and 70 spaced at 90-degree intervals about the circumference of the disk cam 62, and with the switch-closing sector 74 being 135 degrees wide, at least one of the traverse control switches is closed, and, depending on the rotational position of the radial disk cam 62, as controlled by rotation of the control handle 32, the flexible shaft 30 and the cam shaft 50, two of the traverse control switches may be closed simultaneously.

As may be seen in FIG. 5, four concentric sliprings 76, 78, 80, and 82 are provided atop the radial disk cam 62. These are preferably made by adhesively fastening a sheet of copper about 1/16" thick to the top surface of the plastic material of the cam 62, and machining away the undesired portions as the cam is cut to shape. Suitable electrical connections are provided, for example by terminals 83 located on the underside of the disk cam 62 and connected electrically by wires extending through the cam 62 to the respective sliprings, to provide for connection to the respective conductors of the cable 46 located within the interior of the flexible shaft 30. A set of brushes 84, 86, 88 and 90 are mounted in a brush carrier 92, and suitable electrical connections are made between the brushes and the terminal board 60 so that closure of any of the switches 34, 36, and 38 completes a circuit which extends through the appropriate slipring and brush to control operation of the carriage traverse motor 16 and hoist traverse motor 20 in response thereto. Thus, regardless of rotation of the cam 62 and regardless of the direction in which the control handle 32 is pointed, operation of the traverse power control switch 34, hoist raise switch 36, and hoist lower switch 38 will control operation of the motors 16 and 20 and the hoist motor 22.

Figure 7:
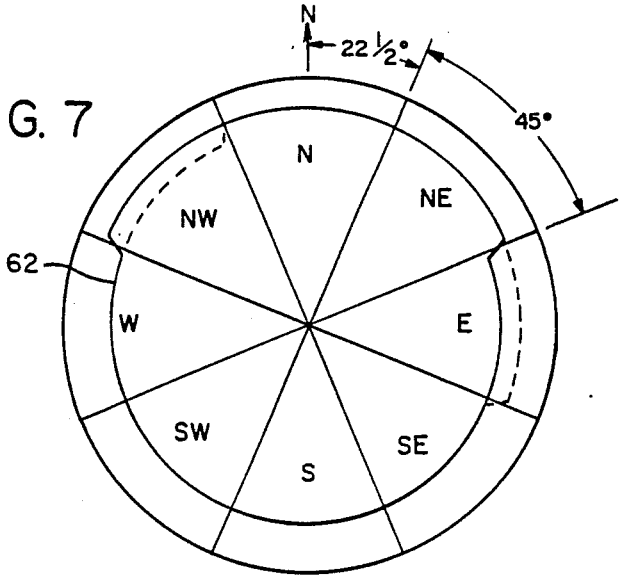
FIG. 7 is a diagrammatic view showing an exemplary directional control plan for the bridge crane shown in FIG. 1.

Referring now also to FIG. 7, when the sector 74 is 135° in width, centered about the direction toward which the control handle 32 is pointed, so long as the control handle 32 is pointed in the sector "N" of FIG. 7, in other words within 22½° on either side of the reference direction (for example, the direction north as indicated in FIG. 7), and assuming that north is at the top of FIG. 5, the north traverse control microswitch 64 alone will be closed by its lever roller 71 being in contact with the sector 74 portion of the face 72. In response to rotation of the control handle 32 corresponding with an operator of the bridge crane 10 turning toward his right 45°, so that the control handle 32 points toward the northeast, the cam 62 will be rotated a similar amount, so that the center of the sector 74 will be directed in the sector NE of FIG. 7, and the rollers 71 of both of switches 64 and 66 will be resting upon the sector 74 portion of the face 72 of the radial disk cam 62. Similarly, depending upon the angular width of the sector 74 and the direction toward which the control handle 32 is pointed, any of the traverse control switches 64, 66, 68 and 70 may be operated individually or together with an adjacent one of the traverse control switches. When either of the switches 64 and 68 is closed separately, the bridge traverse motor 16 will be actuated so as to move the bridge 14 along the rails 12 in the direction indicated by the arrow N, or the arrow S, respectively, in FIG. 1. Similarly, when either of the traverse control switches 66 and 70 is separately closed, the hoist carriage traverse motor 20 will be actuated, moving the hoist carriage 18 along the bridge 14 in the direction indicated by the arrow E or W, respectively. When both the switches 64 and 66 are closed, as when the control handle 32 is pointed within the sector NE, the bridge traverse motor 16 will be actuated in the direction indicated by the arrow N, and the hoist carriage traverse motor 20 will be actuated simultaneously in the direction indicated by the arrow E. Thus, with the precise direction depending upon the relative speeds of movement of the bridge 14 along the rails 12 and the hoist carriage 18 along the bridge 14, a load carried on the hook 24 will be carried in a northeasterly diagonal direction.

Figure 8:
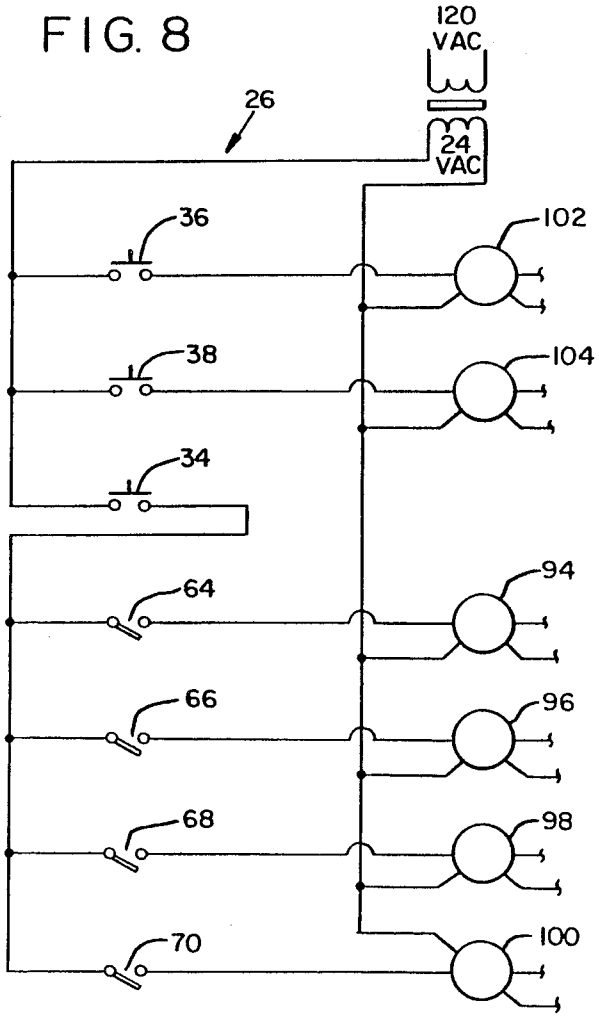
FIG. 8 is an exemplary electrical circuit diagram for the control unit shown in FIG. 2.

Referring now to FIG. 8, each of the traverse motor control switches 64, 66, 68 and 70 is connected to actuate a respective relay 94, 96, 98 and 100 which controls power to the respective motor 16 or 20 to cause it to operate in the proper direction. Similarly, the hoist raise switch 36 and the hoist lower switch 38 are connected, preferably, to respective relays 102 and 104 which, when actuated, cause the hoist motor 22 to operate in the intended direction.

Thus, in the embodiment depicted in the circuit diagram of FIG. 8, the hoist raise switch 36 is connected electrically to a hoist raise relay 94. The hoist lower switch 38 is connected to a hoist lower relay 96. Similarly, the north traverse motor control sWitch 64 is connected electrically with a north traverse relay 98; the east traverse motor control switch 66 is connected with an east traverse relay 100; the south traverse motor control switch 68 is connected with a South traverse relay 102; and the West traverse motor control switch 70 is connected with a west traverse relay 104.

Figure 9:
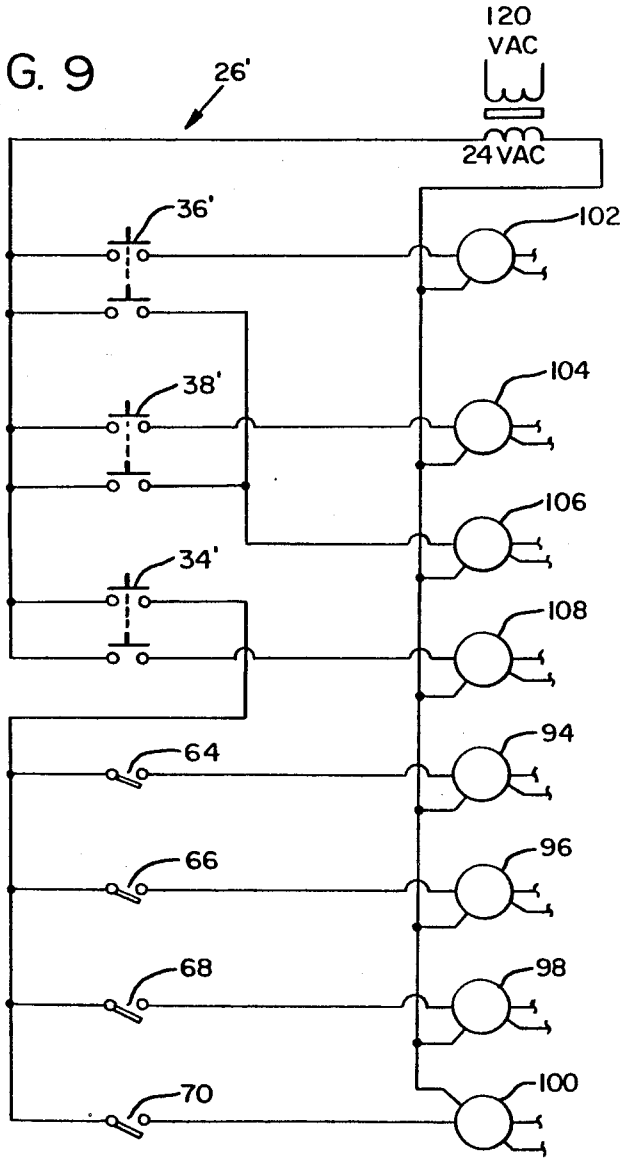
FIG. 9 is a circuit diagram showing an alternative embodiment of the control unit of the invention, including provision for two-speed operation of a bridge crane.

As shown in FIG. 9, in a control unit which is another embodiment of the invention, a traverse power control switch 34', a hoist raise switch 36' and a hoist lower switch 38' each are of a 2-step, sequentially-operated type. Initial movement of the respective switch button closes a first pair of contacts, and further depression of the button closes a second pair of contacts, as well. Closing the second pair of contacts of either the hoist raise switch 36' or the hoist lower switch 38' operates a hoist fast speed relay 106 which increases the speed of a two-speed hoist motor (not shown) in a well known manner. Similarly, the second pair of contacts in the traverse power control switch 34' operates a traverse high speed relay 108 causing a two-speed bridge traverse motor or two-speed hoist carriage traverse motor, or both, as controlled by the direction in which the control handle 32 is pointed, to operate at a higher speed. It will be understood that additional sliprings and brushes (not shown) would be needed in conjunction with the rotatable connection of the hoist control and traverse control switches 34', 36' and 38' in this embodiment of the invention.

Using the one hand bridge crane control unit of FIG. 9, then, it is possible to move the bridge 14 along the rails 12, to move the hoist carriage along the bridge, or to move both simultaneously then moving a load suspended from the hook 24 diagonally, at either of two speeds, according to whether the traverse power control switch 34' is depressed partially or fully. Similarly, it is possible to raise or lower a load suspended on the hook 24 at either a high or low speed depending on whether the hoist raise switch 36' or hoist lower switch 38' is depressed partially or fully.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A control assembly for controlling the operation of a bridge crane of the type including a pair of longitudinal rails, a movable bridge supported on and extending laterally between said rails, a bridge traverse motor for moving the bridge along said longitudinal rails, a hoist carriage movably supported on the bridge, and a hoist carriage traverse motor for moving the hoist carriage laterally along the bridge, the control assembly comprising:

(a) control handle means rotatable about a generally vertical axis for pointing to a direction toward which it is desired to traverse said hoist unit;

(b) a rotary cam;

(c) drive means extending between said control handle means and said rotary cam for rotating said rotary cam in response to rotation of said control handle means;

(d) a plurality of cam followers associated with said rotary cam and located at respective different locations with respect to the rotation thereof; and (e) a plurality of traverse motor control switches, each operatively controlled by a respective one of said plurality of cam followers, each of said traverse motor control switches being connected for controlling operation of a respective one of said bridge traverse motors and hoist carriage traverse motors of said bridge crane in a predetermined direction.

2. The bridge crane control assembly of claim 1, further comprising traverse power control switch means located in said control handle means, for selectively energizing all of said traverse motors of said bridge crane for which respective ones of said plurality of traverse motor control switches are closed.

3. The control unit assembly of claim 2, said bridge crane further including a hoist having a hoist motor, the control unit further comprising hoist control switch means located in said control handle means for selectively energizing said hoist motor in a desired direction.

4. The control unit of claim 3 wherein said traverse power control switch means includes a switch located on said control handle means where it is accessible by an operator's thumb while the operator grasps the control handle means with the hand on which that thumb is located, said hoist control switch means including a hoist raise switch and a separate hoist lower switch, and each of said hoist raise and hoist lower switches being located on said control handle means in a location accessible by an operator's finger while the operator grasps said control handle means with the hand on which said finger is located.

5. The control unit of claim 3 including a plurality of slip rings and corresponding brushes electrically interconnecting said traverse power control switch means with said traverse motor control switches and said hoist control switch means with said hoist motor.

6. The control unit of claim 3 wherein said hoist control switch means includes first, second, and third operative positions and is connected to provide no power to said hoist motor when said hoist control switch means is in said first operative position, to provide power to operate said hoist motor at low speed when said hoist control switch means is in said second operative position, and to provide power to operate said hoist motor at high speed when said hoist control switch means is in said third operative position.

7. The control unit of claim 2 wherein said traverse power control switch means includes first, second, and third operative positions and is connected so as to provide no power to any of said traverse motors when said traverse power control switch means is in said first operative position, to provide power to operate said traverse motors for which respective traverse motor control switches are closed at a low speed when said traverse power control switch means is in said second operative position, and to provide power to operate said traverse motors for which respective traverse motor control switches are closed at a high speed when said traverse power control switch means is in a third operative position.

8. The control unit of claim 1, said cam and said traverse motor control switches being mounted on said hoist carriage, said control unit including a rotatably supported cam shaft and said rotary cam being fastened to said cam shaft for rotation therewith, and said drive means comprising a flexible shaft extending between said control handle means and said cam shaft.

9. The control unit of claim 1, including four traverse motor control switches in said plurality, two of said four being connected electrically for respectively controlling movement of said bridge in each of a pair of opposite longitudinal directions and the other two of said four being connected electrically for respectively controlling movement of said hoist carriage in each of a pair of opposite lateral directions, said rotary cam being a radial disc cam having an edge defining a switch-closing segment having an angular width greater than 90° and less than 180°, and said cam followers being effectively spaced apart about 90° about said cam.

10. The control unit of claim 9 wherein said switch closing segment has an angular width of about 135° in width.

11. The control unit of claim 9, said switch closing segment of said cam being large enough to operate a respective one of said traverse motor control switches when said control unit handle means is directed generally in either of said opposite longitudinal directions or either of said opposite lateral directions and to operate two of said traverse motor control switches simultaneously when said control unit handle means is directed within an angular sector of a predetermined size located between one of said longitudinal directions and one of said lateral directions.

* * * * *